United States Patent [19]

Larsson

[11] Patent Number: 4,953,608

[45] Date of Patent: Sep. 4, 1990

[54] SAFETY DEVICE, PARTICULARLY FOR ROLL-UP DOORS

[75] Inventor: Nils H. I. Larsson, Halmstad, Sweden

[73] Assignee: Nomafa AB, Halmstad, Sweden

[21] Appl. No.: 340,418

[22] PCT Filed: Sep. 9, 1987

[86] PCT No.: PCT/SE87/00405

§ 371 Date: Mar. 17, 1989

§ 102(e) Date: Mar. 17, 1989

[87] PCT Pub. No.: WO88/02804

PCT Pub. Date: Apr. 21, 1988

[30] Foreign Application Priority Data

Oct. 9, 1986 [SE] Sweden ..... 8604283

[51] Int. Cl.[5] ..... E05F 15/20

[52] U.S. Cl. ..... 160/1; 160/133; 160/310; 49/25; 49/28

[58] Field of Search ..... 160/1, 2, 7, 133, 188, 160/189, 310, 312; 49/26, 27, 28, 25

[56] References Cited

U.S. PATENT DOCUMENTS

| | | | |
|---|---|---|---|
| 2,755,081 | 7/1956 | Johnson et al. | 160/188 |
| 2,789,636 | 4/1957 | Lawick | 160/188 |
| 2,909,718 | 10/1959 | Lawick | 160/188 X |
| 3,001,038 | 9/1961 | Gessell | 49/27 X |
| 3,878,879 | 4/1975 | Manns | 160/133 X |
| 4,102,382 | 7/1978 | Vesbach | 160/188 |
| 4,274,226 | 6/1981 | Evans | 49/25 |
| 4,621,452 | 11/1986 | Deeg | 49/25 X |

*Primary Examiner*—David M. Purol

*Attorney, Agent, or Firm*—Kane, Dalsimer, Sullivan, Kurucz, Levy, Eisele and Richard

[57] ABSTRACT

A safety device, particularly intended to be used in roll-up doors to cause reversal of the door closing movements in case an obstacle obstructs the path of movement of the door. The device comprises at least a couple of photoelectric cells which are arranged at a certain distance from the closing edge of the door leaf in alignment with the door leaf on a support arm which is displaceable in the direction of closing of the door.

8 Claims, 2 Drawing Sheets

SAFETY DEVICE, PARTICULARLY FOR ROLL-UP DOORS

BACKGROUND OF THE INVENTION

The subject invention concerns a safety device, which is intended to be used particularly in roll-up doors for the purpose of causing reversal of the closing movement of the door when an object is obstructing its path of movement. The safety device is of the kind comprising at least one signalling means which is arranged to emit a beam of light, a beam of sound or another kind of signalling beam and which is supported by the door leaf some distance from the door leaf closing edge.

One example of prior-art safety devices for doors is formed with a sealing strip which is positioned at the lower edge of the door leaf. The sealing strip consists e.g. of a hollow strip of soft rubber, the ends of which are sealed to enclose a quantity of air in the interior of the strip. Should the door leaf hit an obstacle, while moving downwards into its fully closed position, the air inside the sealing strip is compressed, resulting in actuation of a diaphragm valve to reverse the closing movements of the door leaf. This construction does, however, suffer from the disadvantage that it is comparatively fragile and sensitive, since the slightest leakage makes the device inoperative.

Considering that doors of this kind are frequently damaged, for instance by trucks and other vehicles passing through the doorway, the use of highly sensitive sealing strips is not very advisable. Another serious drawback inherent in this prior-art structure is that reversal of the door leaf movements is not initiated until the leaf hits the object which is obstructing its path of movement.

In another prior-art structure the problem is solved thereby that instead of enclosing an air cushion inside the lower sealing strip a photoelectric cell is used the beam of which is arranged to pass through the strip. Although this structure is leakage-proof, it still depends on deformation of the strip for the initiation of the reversal of the door movements.

In accordance with a third prior-art structure which suffers from disadvantages identical with those inherent in the first two prior-art structures discussed in the aforegoing two copper rails are mounted on the strip which rails are kept apart by a spring of a non-conductive material.

Finally, it is also known to use photoelectric cells which are positioned closely above the floor level. Although this structure does not depend on contact between the door leaf and the obstructing object for its operation persons may easily climb over the beam of the photoelectric cell and the forks of fork-lift trucks may pass over it, and so the device will fail to operate. This prior-art structure could be combined with any one of the structures referred to in the aforegoing which become operative to reverse the closing movement of the door leaf upon contact with an obstructing object. However, combinations of this kind suffer from the disadvantage that also in such cases contact is required between the door leaf and the obstructing object to make the safety device operative, in addition to which installation thereof is comparatively expensive because of the necessity to double the sensing means.

SUMMARY OF THE INVENTION

The purpose of the subject invention is to provide an efficient safety device which is intended for door leaves and similar structures and which is designed so as to be able to cause reversal of the closing movement of the door leaf without having to touch the object obstructing the path of the movement of the door leaf. In addition, the safey device in accordance with the invention is designed so as to positively exclude the possibility of anyone stepping across it by mistake, which results in failure to initiate operation of the device, and it is also designed to completely relieve the door leaf and effect positive stopping of the door leaf movements within five seconds, thus fulfilling the safety regulations laid down by the authorities.

For this purpose, the safety device in accordance with the invention comprises at least one signal emitting means which is arranged to emit a beam of light or a beam of sound or a signalling beam of another nature across the width of the door leaf at such a distance from the lower closing edge of the door leaf that any object that interrupts the beam emitted by the signalling means causes reversal or standstill of the closing movement of the door leaf before the edge thereof hits the obstructing object, said device being characterized therein that the signalling means is mounted on a support arm which is slideably mounted in a holder mounted at a lower part of the door-leaf and which support arm is arranged to abut against the floor or a stand upon closing of the door so that the signalling means is displaced relatively to and towards the door-leaf to a position at least level with the lower closing edge of said door-leaf during the final closing movement thereof.

BRIEF DESCRIPTION OF THE DRAWINGS

A particularly advantageous embodiment of the invention will be described in the following with reference to the accompanying drawings, wherein.

DETAILED DESCRIPTION OF A PREFERRED EMBODIMENT

Figure 1:
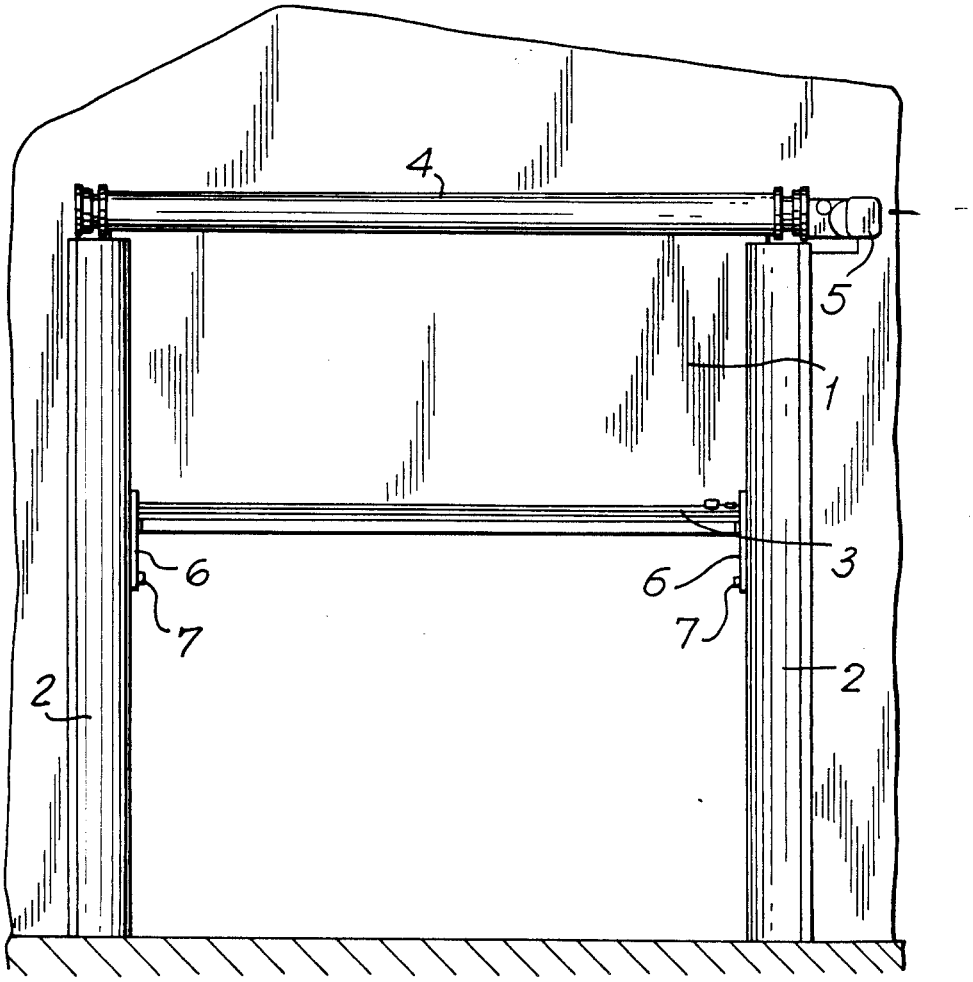
FIG. 1 is a front view of a roll-up door equipped with a safety device in accordance with the invention.

The roll-up door in accordance with the invention and shown in FIG. 1 essentially comprises a roll-up door leaf 1, two posts 2, a lower cross beam 3, an upper cross beam 4 onto which the door-leaf 1 is wound to open the door, a motor 5 to actuate the roll-up movements, and a safety device 6.

Figure 3:
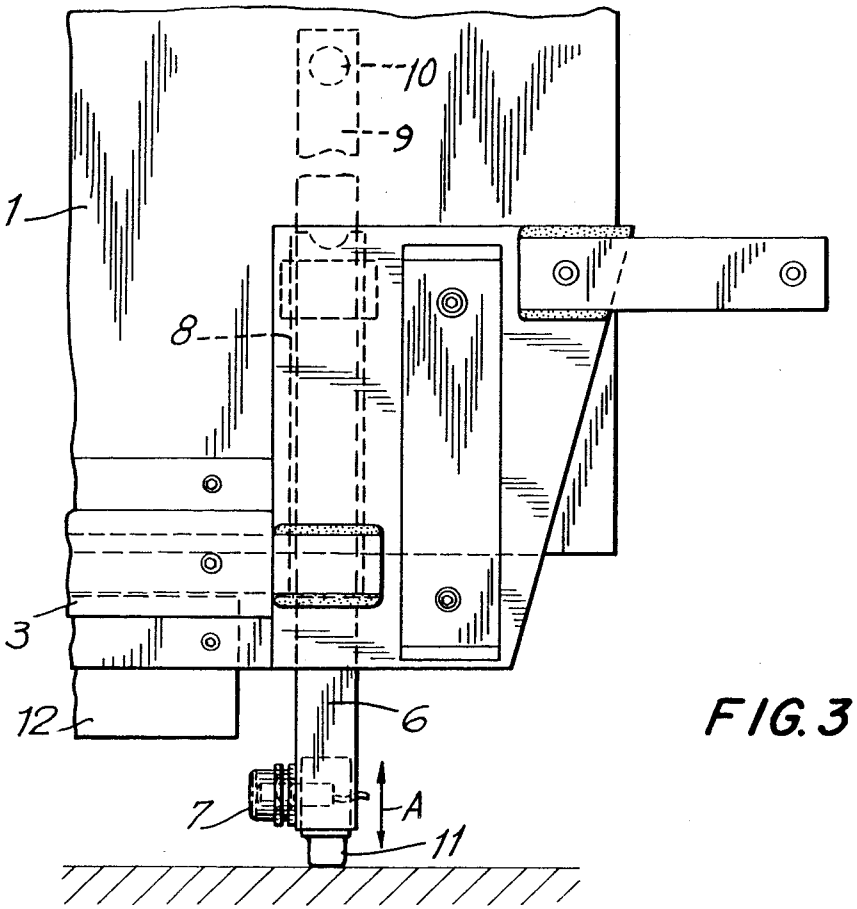
FIG. 3 is a front view of the details in accordance with FIG. 2.
Figure 2:
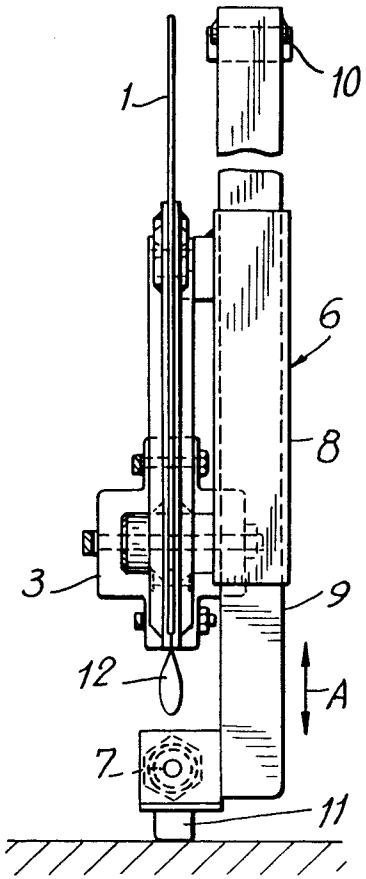
FIG. 2 is a lateral, partly broken view of the door which illustrates the device in accordance with the invention on an enlarged scale, supported by a door leaf.

One half of this safety device 6 is shown in detail in FIGS. 2 and 3. It essentially comprises a photoelectric cell 7, a displaceable cell support arm 9 which is slidably mounted in a tubular holder 8, a stop limit edge 10 designed to determine the lower position of the arm 9, and an abutment 11 which is designed to abut against the floor when the door leaf 1 is approaching and in its fully door-closing position. FIGS. 2 and 3 illustrate the door leaf 1 in the position it occupies when it is so close to its door-closing position that the abutment 11 hits the floor.

The safety device 6 in accordance with the invention operates in the following manner. When the beam of light extending between the two photoelectric cells 7, one at either side of the door leaf, is interrupted during the closing movement of the door leaf 1 this movement is reversed immediately. The reversal occurs so rapidly that the lower edge of the door leaf 1 will not hit the object that obstructs the path of the beam of light.

As alternatives to a beam of light extending between two photoelectric cells 7, a beam of sound or another kind of signalling beam extending between the appropriate generating and detecting means on either side of the door leaf 1 could be used to indicate the presence of an object beneath the closing door.

In order to allow the photoelectric cells to be mounted at a sufficiently high level below the lower edge of the door leaf 1 without blocking the way when the door is closing, they are displaceable in the direction indicated by arrow A relative to the door leaf 1. Displacement of the photoelectric cells is achieved by arranging the photoelectric cell support arm 9 in such a manner that it slides freely in the tubular holder 8 which is formed integral with the door leaf 1. A stopper means or limiting means 10 is attached to the upper end of the support arm 9 in order to retain the latter inside the tubular holder 8 and to ensure that both photoelectric cells 7 assume a position at the same level above the lower edge of the door leaf 1. When the door leaf was progressed so far downwards that the photoelectric cells 7 approach the floor, the abutment 11 hits the floor whereby the arm 9 slides upwards relative to the door leaf. Furthermore, the device is connected in a manner ensuring that the operation thereof ceases immediately before the door leaf reaches it fully closed position. This avoids interruption of the beam of light between the photoelectric cells 7 by means of the sealing strip 12 which is mounted at the lower transverse beam 3 on the lower edge of the door leaf 1.

Finally, it should be mentioned that the invention is not limited to the embodiment described in the aforegoing but that several embodiments are possible within the scope of the appended claims. For instance it is possible to fit the support arm 9 with a series of vertically positioned photoelectric cells to remove the possibility that an object which is pushed in between the beam of light and the lower edge of the door leaf is hit by the door.

What I claim is:

1. A safety device, particularly intended for use in a roll-up door, said roll-up door including a roll-up door leaf extending horizontally between two upright posts defining a width for said roll-up door, said roll-up door further including an upper cross beam onto and off of which said door leaf is wound to open and close said roll-up door, respectively, and a lower cross beam connected to a bottom edge of said door leaf, said bottom edge of said door leaf being adjacent to a plane base surface when said roll-up door is in a closed position, said safety device comprising at least one signal emitting means (7) which is arranged to emit a signalling beam across the width of the door-leaf at a distance below the lower cross beam on said bottom edge of the door-leaf so that any object, obstructing a movement of the roll-up door into said closed position, interrupts the signalling beam emitted by the signalling means and causes a stopping of the closing movement of the door-leaf before the bottom edge thereof hits said object, characterized therein that the signal emitting means (7) is mounted on a support arm (9) which is slideably mounted in a holder (8) mounted on said lower cross beam, said support arm (9) arranged to abut against said plane base surface upon closing of the door so that the signal emitting means are displaced relatively to and towards the door-leaf to a position at least in level with the bottom edge of said door-leaf during the final closing movement thereof.

2. A safety device as claimed in claim 1, characterized therein that the signal emitting means (7) are positioned in vertical alignment with the door-leaf.

3. A safety device as claimed in claim 1, characterized therein that the safety device (6) is arranged to be disconnected when the door reaches a position at a predetermined level above the closed position.

4. A safety device as claimed in claim 1, characterized therein that said signal emitting means are a photoelectric cell.

5. An improved safety device, particularly intended for use in roll-up doors of the kind comprising a door-leaf and an overhead roll-up roller, said door leaf arranged to be wound onto and off of said roll-up roller for opening and closing movements, respectively, said door-leaf extending horizontally between two upright posts defining a width for said roll-up door, said roll-up door further including a lower cross beam connected to a bottom edge of said door-leaf, said bottom edge of said door-leaf being adjacent to a plane base surface when said roll-up door is in a closed position, said safety device comprising at least one signal emitting means, said means arranged to emit a signalling beam across the width of said door-leaf at a distance below the lower cross beam on said bottom edge of said door-leaf so that any object obstructing a movement of said door into a closed position interrupts said signalling beam emitted by said signal emitting means and causes a stopping of said closing movement of said door-leaf before the bottom edge thereof hits said object, said improved safety device comprising:

a support arm on which said signal emitting means is mounted;

a holder mounted on said lower cross beam and slidingly receiving said support arm therein;

said support arm arranged to abut against said plane base surface upon closing of said door so that said signal emitting means are displaced relatively to and towards said door-leaf to a position at least level with the bottom edge of said door-leaf during the final closing movement thereof.

6. An improved safety device as claimed in claim 5, wherein said signal emitting means are positioned in vertical alignment with said door-leaf.

7. An improved safety device as claimed in claim 5 wherein said signal emitting means are a photoelectric cell.

8. An improved safety device as claimed in claim 5, wherein said safety device is arranged to be disconnected when said door reaches a position at a predetermined level above said closed position.

* * * * *